US005311988A

United States Patent [19]

Bronson

[11] Patent Number: 5,311,988

[45] Date of Patent: May 17, 1994

[54] PRESSURIZING CAP AND METHOD FOR USING SAME

[76] Inventor: Henry D. Bronson, 904 St. Stephens Green, Oak Brook, Ill. 60521

[21] Appl. No.: 952,961

[22] Filed: Sep. 29, 1992

[51] Int. Cl.[5] ..... B65D 85/00

[52] U.S. Cl. ..... 206/315.9; 220/306; 215/321

[58] Field of Search ..... 206/315.9, 315.91; 220/306, 356; 215/321, 317, 353

[56] References Cited

U.S. PATENT DOCUMENTS

| | | | |
|---|---|---|---|
| 1,910,930 | 5/1933 | Morris . | |
| 1,911,125 | 5/1933 | Miller . | |
| 2,947,432 | 8/1960 | Marcel | 215/321 |
| 2,962,187 | 11/1960 | Morris | 220/306 |
| 3,133,663 | 5/1964 | Schurman et al. | 220/306 |
| 3,233,727 | 2/1966 | Wilson . | |
| 3,288,320 | 11/1966 | Swanson | 215/321 |
| 3,470,930 | 10/1969 | Jurczenia | 220/306 |
| 3,527,375 | 9/1970 | Klein | 220/306 |
| 3,581,881 | 6/1971 | Hobbs . | |
| 3,819,040 | 6/1974 | Coons | 206/315.9 |
| 3,853,222 | 12/1974 | Helms | 206/315.9 |
| 3,888,347 | 6/1975 | Kramer | 206/315.9 |
| 3,897,874 | 8/1975 | Coons | 206/315.9 |
| 4,019,629 | 4/1977 | Dubner et al. | 206/315.9 |
| 4,020,948 | 5/1977 | Won | 206/315.9 |
| 4,555,042 | 11/1985 | Rathbun | 220/306 |
| 4,729,472 | 3/1988 | Lubin | 206/315.9 |

FOREIGN PATENT DOCUMENTS

| | | | |
|---|---|---|---|
| 2219280 | 6/1989 | United Kingdom | 206/315.9 |

*Primary Examiner*—Paul T. Sewell
*Assistant Examiner*—M. D. Patterson
*Attorney, Agent, or Firm*—Willian Brinks Hofer Gilson & Lione

[57] ABSTRACT

A pressurizing cap for a conventional tennis ball container includes a sleeve that defines an internal sealing surface shaped to seal against a lip defined by the tennis ball container as the sleeve is moved axially along a stroke when the sleeve is applied to the container. The pressurizing cap includes an end panel sealed to a closed end of the sleeve and the cap defines an annular recess adjacent to the sealing surface near the end panel. This recess is shaped to receive the annular lip and to hold the cap releasably in place on the container. The cap can be placed on the container and then moved axially into position on the container without rotation. The sliding seal created between the lip of the container and the internal sealing surface causes movement of the cap toward the container to pressurize the container.

16 Claims, 3 Drawing Sheets

PRESSURIZING CAP AND METHOD FOR USING SAME

BACKGROUND OF THE INVENTION

This invention relates to a pressurizing cap for use in pressurizing a container of the type having at least one sidewall that defines an open end, and an annular lip extending radially from the open end. As described below this pressurizing cap may be used to provide a pressurized storage environment for racket-sport balls such as tennis balls.

Racket-sport balls such as tennis balls are originally packaged in pressurized containers, and such balls begin to deteriorate when the containers are opened and the balls are kept at atmospheric pressure. In the past, several approaches have been suggested for pressurizing containers that can be used to increase the effective life of such balls, as disclosed in the following patents:

| U.S. Pat. No. | Inventor(s) |
|---|---|
| 4,020,948 | Won |
| 4,019,629 | Dubner, et al. |
| 3,897,874 | Coons |
| 3,888,347 | Kramer |
| 3,853,222 | Helms |
| 3,819,040 | Coons |
| 3,581,881 | Hobbs |
| 3,233,727 | Wilson |
| 1,911,125 | Miller |
| 1,910,930 | Morris |

As illustrated by the Wilson. Miller and patents, one approach is to provide a pressurizing container with a valve that allows pressurized air to be admitted into the container. Another approach is to supply a piston pump as an integral part of the container, as disclosed in the Kramer, Dubner, Helms and Morris patents. The Dubner and Helms patents disclose caps that include integral pumps, and that are designed for use with conventional tennis ball containers.

Another approach as illustrated by the Won and Coons patents is to provide a container having an externally threaded base and an internally threaded lid. The base and lid are provided with seals such that rotation of the lid simultaneously moves the lid to the closed position and pressurizes the internal volume contained by the body and the lid. A major disadvantage of this approach is that it requires a custom container having external threads to receive the lid.

It is an object of this invention to provide an improved, simplified pressurizing cap which preferably can be used with a conventional container to pressurize the contents of the container.

SUMMARY OF THE INVENTION

According to the apparatus of this invention, a pressurizing cap is provided for a container of the type described initially above. This cap comprises a sleeve defining a sealing surface shaped to seal against the lip as the sleeve is moved axially along a stroke when the sleeve is applied to the container. The sleeve defines an open end and a closed end, and an end panel is sealed to the closed end of the sleeve. The cap defines a annular recess adjacent to the sealing surface near one end of the sleeve, and this recess is shaped to receive the annular lip and to hold the cap releasably in place on the container.

According to the method of this invention, a container and a pressurizing cap of the type described above are provided, the cap is placed on the container with sealing surface of the in sealing engagement with the lip, and the cap is then caused to move axially along a stroke relative to the container until the recess receives the lip; to hold the cap in place. During this stroke the lip seals against the sealing surface of the cap such that movement of the cap pressurizes the container. Preferably, this last step is performed without rotating the cap with respect to the container.

The preferred embodiment described below eliminates the need for threads on either the cap or the container, and has been designed for use with a conventional container such as a conventional tennis ball container. The pressurizing cap described below is relatively simple to manufacture at relatively low cost, it is easy to use with a conventional tennis ball container, and it is well suited for reuse with multiple successive containers.

DETAILED DESCRIPTION OF THE PRESENTLY PREFERRED EMBODIMENTS

Figure 1:
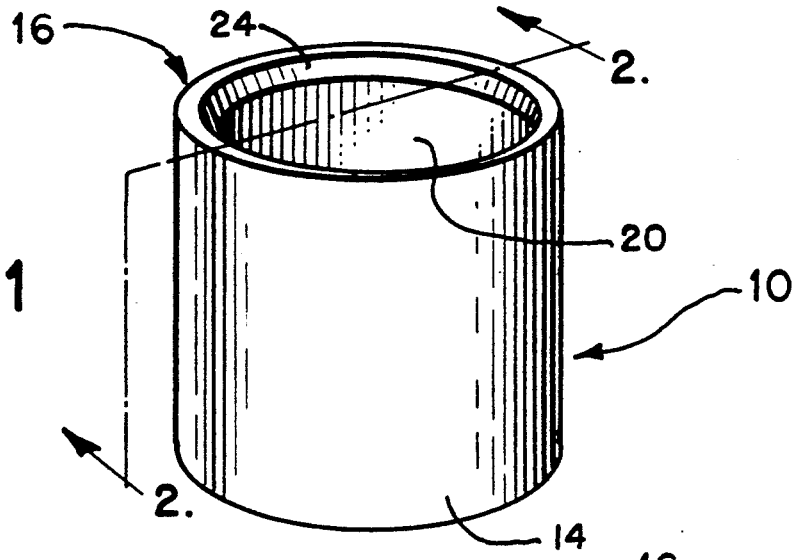
FIG. 1 is a perspective view of a presently preferred embodiment of the pressurizing cap of this invention.
Figure 2:
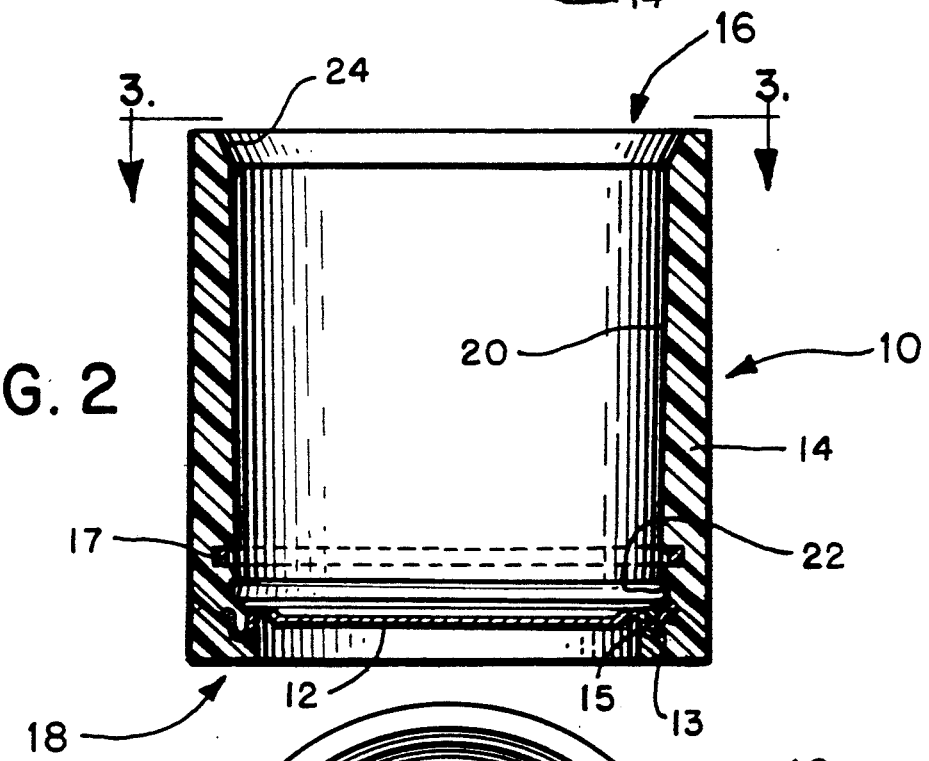
FIG. 2 is a cross sectional view taken along line 2—2 of FIG. 1.
Figure 3:
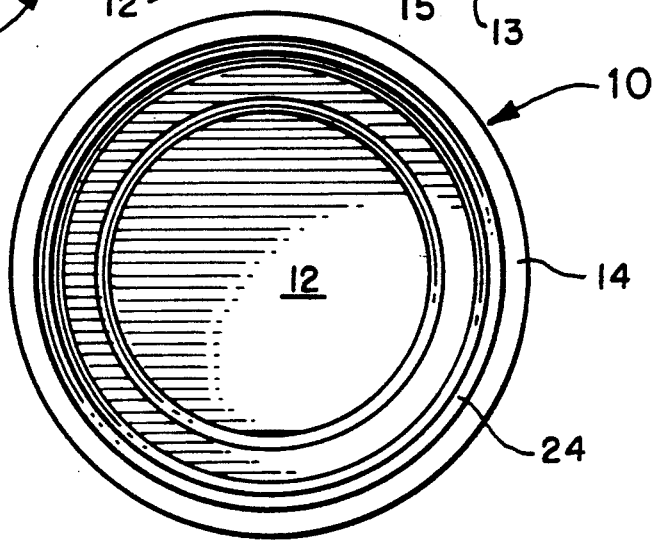
FIG. 3 is a bottom view taken along line 3—3 of FIG. 2.

Turning now to the drawings, FIGS. 1–3 show three views of a pressurizing cap 10 which incorporates a presently preferred embodiment of this invention. As best shown in FIG. 2, the pressurizing cap 10 includes an end panel 12 and a generally cylindrical sleeve 14. The sleeve 14 defines an open end 16 and a closed end 18. Preferably, the sleeve 14 is molded to the end panel 12 at the closed end 18. The interior surface of the sleeve 14 defines a sealing surface 20 which is generally cylindrical in shape. Preferably, the sealing surface 20 is slightly tapered such that it has a smaller diameter near the closed end 18 than near the open end 16. For example, the sealing surface 20 can be generally frusto-conical in shape.

A recess 22 is formed in the sleeve 14 adjacent one end of the sealing surface 20, between the sealing surface 20 and the end panel 12. This recess 22 is shaped to receive and releasably retain the lip of a container as described below. A frusto-conical lead-end surface 24 is provided adjacent the sealing surface 20 at the open end 16. The sleeve 14 and in particular the sealing surface 20 and the area around the recess 22 are preferably formed of an elastomeric material such as urethane which is well suited to provide a sliding seal as described below.

Several measures have been taken to strengthen the sleeve 14 adjacent the recess 22 against undesired radial expansion. First, the sleeve 14 is mechanically interlocked with the end panel 12 to prevent the closed end 18 of the sleeve 14 from moving radially outwardly. In this embodiment the end panel 12 is a conventional metal can end that defines an axially extending circumferential wall 13 that forms an outer boundary for an annular recess 15. The sleeve 14 is molded to fill the recess 15, and the wall 13 is therefore mechanically interlocked with the sleeve 14.

Second, a reinforcing ring 17 is molded into the sleeve 14 near the recess 22. This ring 17 may include a wrapped tension member such as a cord of a high strength material such as Kevlar (TM). The ring 17 is not required in all embodiments.

Figure 8:
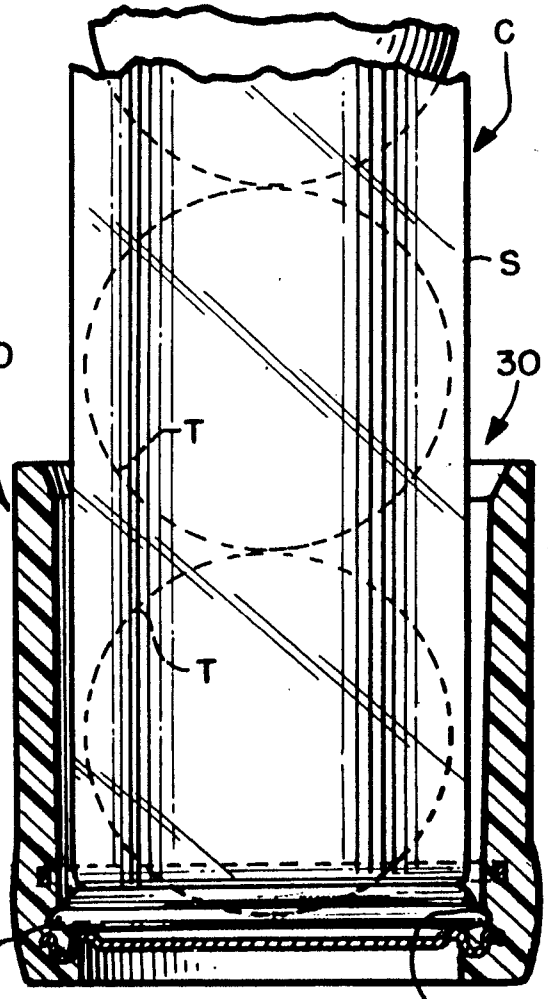
FIG. 8 is a view corresponding to FIGS. 6 and 4 showing the cap fully seated on the tennis ball container.
Figure 7:
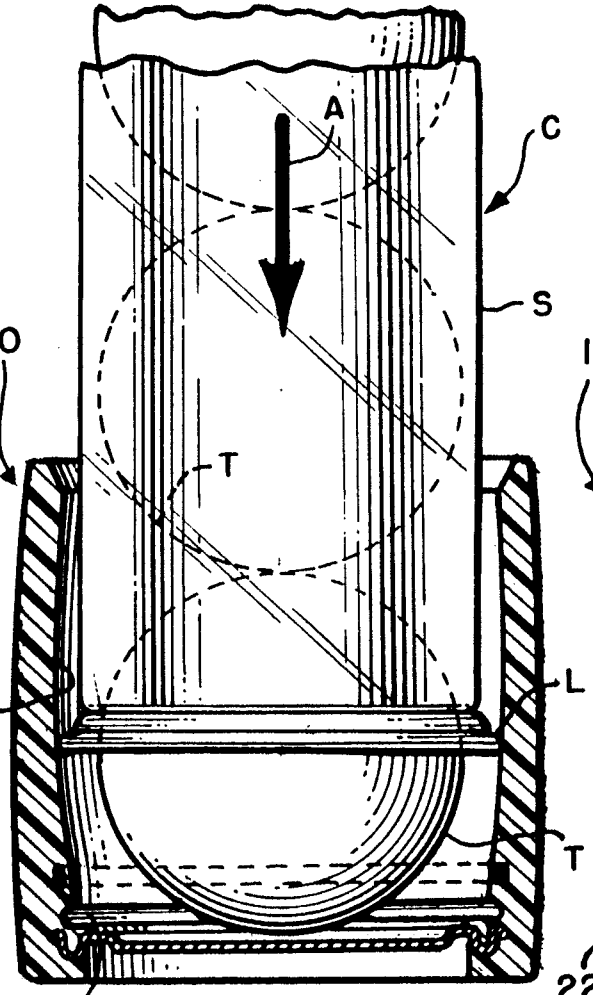
FIG. 7 is a view corresponding to FIG. 6 with the container pushed downwardly to an intermediate position on the cap.
Figure 6:
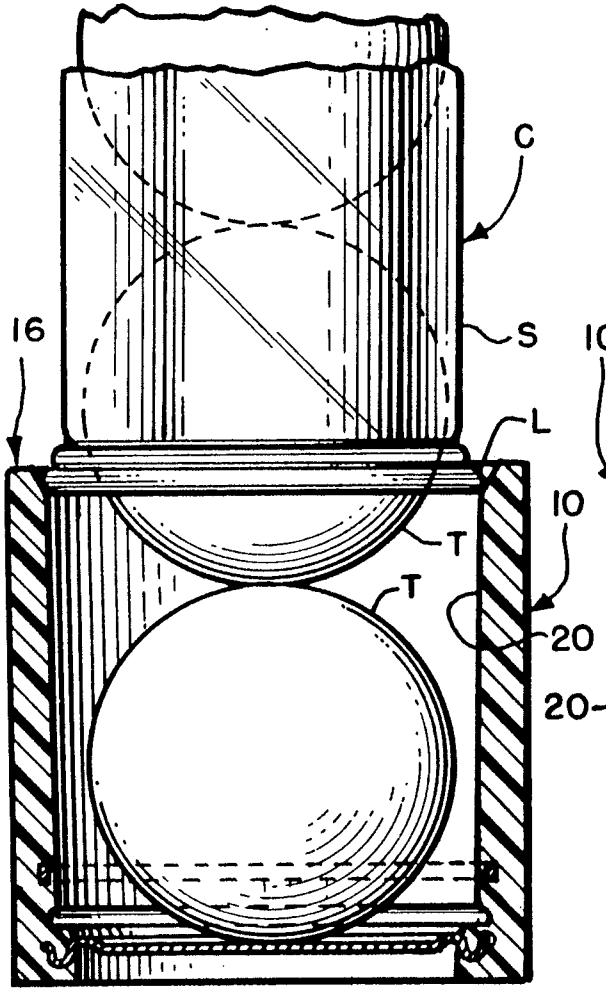
FIG. 6 is a cross sectional view of the pressurizing cap of FIGS. 1–3 positioned on a conventional tennis ball container.

As best shown in FIGS. 6–8, the pressurizing cap 10 is designed for use with a container C which in this preferred embodiment is a conventional tennis ball container. The container C includes a cylindrical sidewall S that defines a lip L adjacent an open end of the sidewall S. This lip L extends radially outwardly, and is commonly found on conventional tennis ball containers. The container C is sized to receive three racket-sport balls such as tennis balls T, and the container C is closed at the end opposite the lip L.

In order to use the cap 10 to pressurize the container C, the cap 10 is initially placed on the container C as shown in FIG. 6. In this position the sealing surface 20 adjacent the open end 16 creates a sliding seal with the lip L.

The user then applies compressive forces in the direction of the arrow A, thereby moving the cap 10 relative to the container C to the intermediate position shown in FIG. 7. As the cap 10 moves relative to the container C, the sealing surface 20 provides a sliding seal against the lip L, substantially preventing the escape of air therebetween.

As shown in FIG. 8, this motion continues until the cap 10 reaches its fully seated position on the container C, and the lip L is received in the recess 22. In this position the recess 22 engages the lip L and releasably retains the cap 10 in place on the container C, thereby creating a pressurizing enclosure 30. Additionally, the lip L creates a pressure seal against the walls of the recess 22, thereby preventing the escape of air from the pressurizing enclosure 30.

As the cap 10 is moved relative to the container C from the position of FIG. 6 to the position of FIG. 8, the contained volume of the pressurizing enclosure 30 is reduced, and the pressure inside the enclosure 30 is therefore increased. By properly selecting the dimensions of the cap 10 the desired degree of pressurization can be obtained. For example, if the volume of the cap 10 is equal to the free volume of the container C (the volume of the container C not occupied by the balls T) then the volume of the enclosure will be reduced by fifty percent as the cap 10 is moved into position on the container C, thereby pressurizing the internal volume to about 12–14 psig. In general the volume of the cap 10 is preferably greater than one half the free volume of the container C.

In most applications it will be preferable to have the length of the sealing surface 20 measured in the direction of the arrow A greater than or equal to one-half of the diameter of the sealing surface 20, and in most applications it will be preferable to have the length of the sealing surface 20 (which defines the stroke of the pump formed by the cap 10 and the container C) greater than or equal to 2 inches in length.

A number of important advantages should be apparent from the foregoing discussion. First, the cap 10 is relatively simple to manufacture, and it completely eliminates the needs for threads on either the cap 10 or the container C. Second, the cap 10 is easily and quickly placed on the container C with a single direct push, without rotating the cap with respect to the container. Because the sleeve 14 is formed of an elastomeric material, the cap 10 can be released from the container C by pushing the cap 10 upwardly. When this happens friction between the lip L and the sealing surface 20 ensures that the cap 10 moves gradually from its closed to its opened position, and not explosively, and in effect the entire cap 10 acts as a safety valve. As indicated above, it is presently preferred to taper the sealing surface 20 to increase the sealing forces between the sealing surface 20 and the lip L as the lip L approaches the recess 22 and the pressure within the enclosure 30 increases.

Sealing of the cap 10 to the lip L is dependable because the long wiping action on the sealing surface 20 distributes wear and is little damaged by grit. Pressure in the container C is easily verified by merely squeezing the container C to gauge its stiffness.

Figure 5:
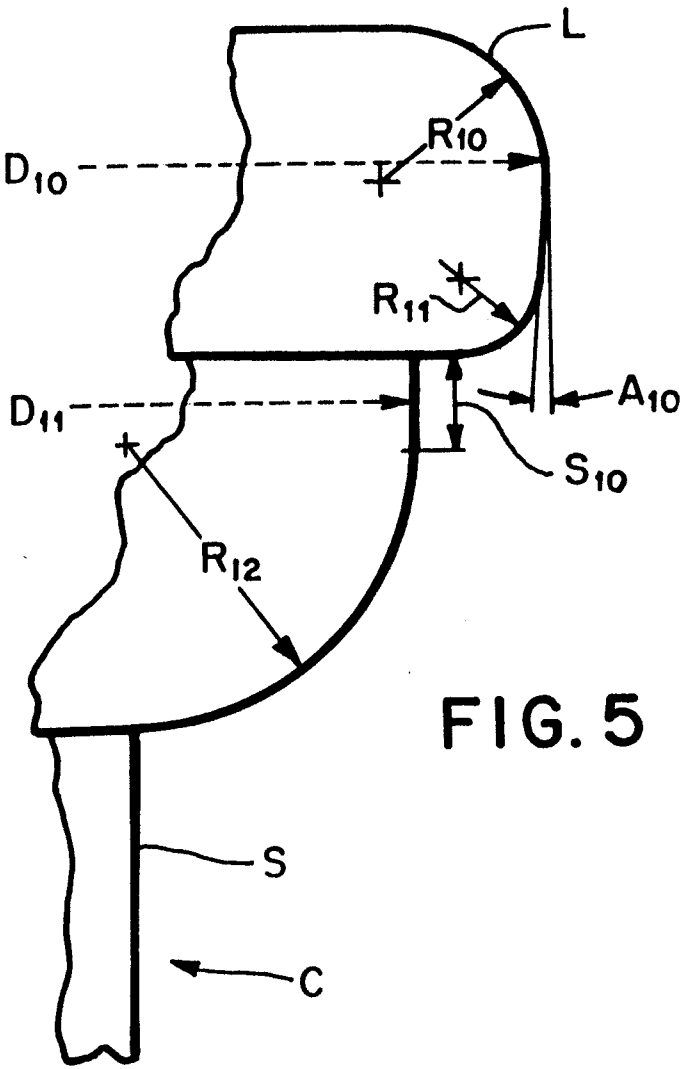
FIG. 5 is an enlarged fragmentary cross sectional view of a lip of a conventional tennis ball container.
Figure 4:
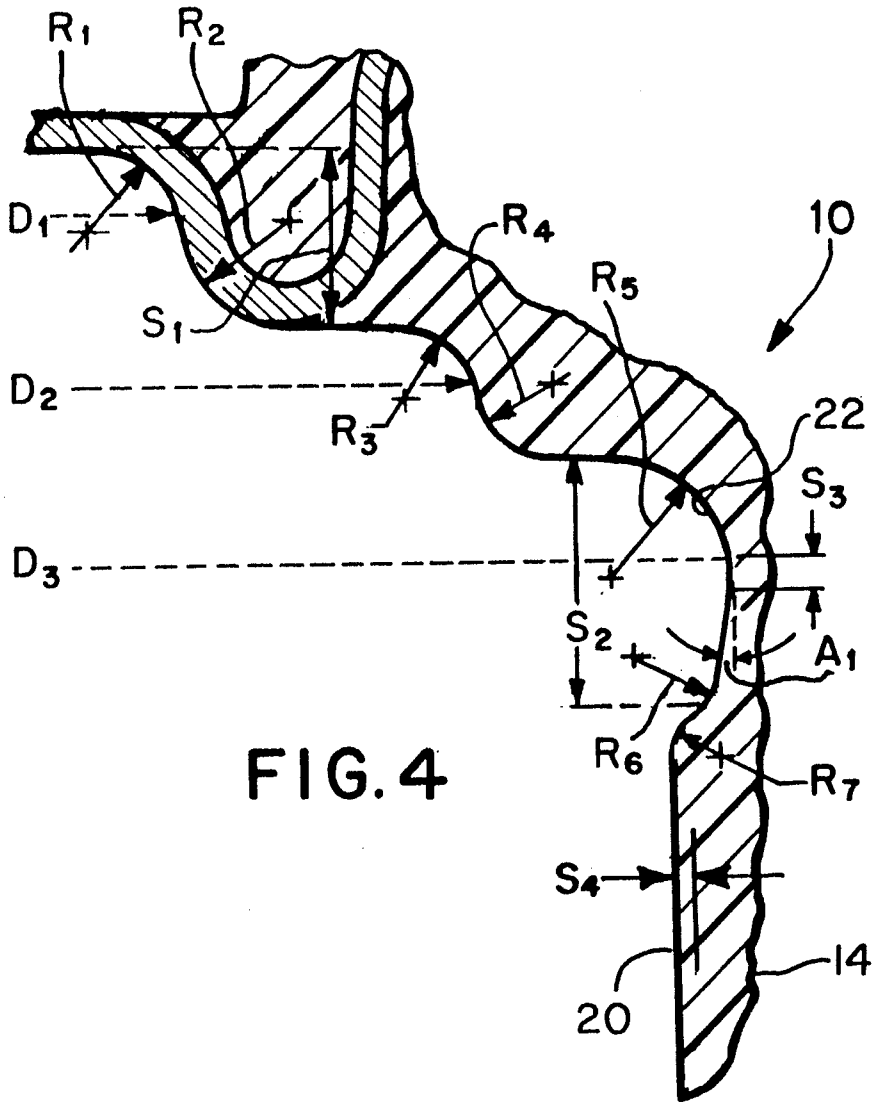
FIG. 4 is an enlarged fragmentary sectional view of a recess formed in an interior wall of the cap of FIGS. 1–3.

The recess 22 has been designed to engage the lip L so as to hold the cap 10 in place with a force of 90 pounds tending to move the cap 10 outwardly, but still be easily removable. Several features of the shape of the recess 22 are believed to be particularly important. First, the maximum diameter D3 of the recess 22 (FIG. 4) is less than the outer diameter D10 of the lip L (FIG. 5). This promotes reliable sealing, because the material of the cap 10 adjacent the recess is kept in tension around the lip L. Second, the recess 22 has been shaped in the region of A1, R6 and R7 (FIG. 4) to allow the cap 10 to be removed with reasonable force without tearing the walls of the recess 22. In particular, the concave curvature R6 has a radius of curvature of 0.02 to 0.04 inches (preferably 0.03 inches), and the concave curvature R6 is greater than the convex curvature R7. Also, the recess 22 tapers in diameter by the angle A1 toward the open end 16, and this angle A1 is in the range of 5–11 degrees (preferably about 8°).

The following details of construction are provided in order to define the preferred embodiment more completely. These details of construction are of course only intended by way of illustration, and should not be considered as limiting the scope of the following claims. In this preferred embodiment the end panel 12 is a conventional paint can end, and the sleeve 14 is molded to the end panel 12 and is formed of an elastomeric material such as the urethane resin distributed by UniRoyal Chemical under the trade name Adiprene L-83. This resin is polyether TDI based urethane with 2,4 and 2,6 isomers of dimethylthiotoluenediamine. Preferably the sleeve 14 has a durometer of 80±5 (Shore A) and the diameter of the sealing surface 20 is preferably slightly less than that of the lip L adjacent the open end 16 and tapers at an angle of about 0° 34 minutes The length of the sealing surface 20 is preferably 3.5 inches to produce a pressure of 12–14 psig.

The following table lists preferred dimensions for the cap 10 designed for use with the container C of FIG. 5.

| | Reference Symbol | Dimension (inches or degrees) |
|---|---|---|
| Cap 10 (FIG. 4): | D1 | 2.505 |
| | D2 | 2.755 |
| | D3 | 2.976 |
| | R1 | 0.031 |
| | R2 | 0.047 |
| | R3 | 0.031 |
| | R4 | 0.031 |
| | R5 | 0.047 |
| | R6 | 0.030 |
| | R7 | 0.015 |
| | S1 | 0.077 |
| | S2 | 0.1115 |
| | S3 | 0.010 |
| | S4 | 0.015 |
| | A1 | 8° 21 min. |
| Container C (FIG. 5): | D10 | 2.998 |
| | D11 | 2.905 |
| | R10 | 0.050 |
| | R11 | 0.022 |
| | R12 | 0.100 |
| | S10 | 0.030 |
| | A10 | 6° |

In FIG. 5, the region including R10 and R11 is a radially outwardly extending lip L formed of aluminum that is crimped onto the open end of the sidewall S.

Of course, it should be understood that a wide range of changes and modifications can be made to the preferred embodiment described above. The cap 10 can be provided with shapes and sizes suitable for use with other containers, and the material and the hardness of the material can be selected as desired In the event the lip protrudes inwardly the sealing surface 20 can be arranged to face outwardly rather than inwardly, and the end panel 12 can be positioned at the opposite end of the sleeve 14 from the recess.

It is therefore intended that the foregoing detailed description be regarded as illustrative rather than limiting, and that it be understood that it is the following claims, including all equivalents, which are intended to define the scope of this invention.

I claim:

1. A pressurizing enclosure for racket-sport balls comprising:

a container sized to receive racket-sport balls, said container comprising a sidewall that comprises an open end and an annular lip extending radially outwardly from the open end;

a pressurizing cap comprising an end panel, a sleeve sealed to the end panel and comprising an inwardly facing annular sealing surface formed of an elastomeric material which forms a seal against the lip, and an annular recess positioned near one end of the sealing surface, said recess receiving the annular lip to hold the cap releasably on the container;

the volume of the sleeve being at least one half of the free volume of the container; and said cap pressurizing a volume bounded by the container and the cap as the cap is pushed into position on the container and the lip slides along the elastomeric sealing surface and then into the recess.

2. The invention of claim 1 wherein the sidewall of the container is free of threads.

3. The invention of claim 1 wherein the sealing surface is substantially circular in cross section and tapered, with a cross-sectional diameter that increases with increasing distance from the recess.

4. The invention of claim 1 wherein the container is a container for racket-sport balls.

5. The invention of claim 1 wherein the lip extends radially outwardly from the sidewall and wherein the sealing surface is inwardly facing.

6. The invention of claim 1 wherein the outer diameter of the lip is greater than the maximum diameter of the recess.

7. The invention of claim 6 wherein the recess is positioned adjacent to the end panel.

8. The invention of claim 1 wherein the end panel is mechanically interlocked with the sleeve adjacent the recess to strengthen the sleeve against radial expansion.

9. The invention of claim 1 wherein the cap comprises an elastomeric material having a durometer of about 80 (Shore A).

10. The invention of claim 1 wherein the cap further comprises a ring shaped tension member positioned in the sleeve near the recess to brace the sleeve against radial expansion.

11. A method of pressurizing a container for racket-sport balls comprising the following steps:

a) providing a container containing at least one racket-sport ball, said container comprising a sidewall that comprises an open end and an annular lip extending radially outwardly from the open end;

b) providing a pressurizing cap comprising a sleeve comprising an inwardly facing sealing surface formed of an elastomeric material which forms a seal against the lip, and end panel secured to one end of the sleeve, said cap comprising an annular recess adjacent the sealing surface, said recess receiving the lip to hold the cap releasably on the container, the volume of the cap being no less than about one half the free volume of the container;

c) placing the cap on the container with the sealing surface of the cap in sealing engagement with the lip; and d) pushing the cap along a stroke toward the container until the recess receives the lip to hold the cap in place, said lip sliding along and sealing against the elastomeric sealing surface of the cap through the stroke such that movement of the cap pressurizes the container around the racket-sport balls.

12. The method of claim 11 wherein the pushing step (d) is performed without rotating the cap with respect to the container.

13. The method of claim 11 wherein the providing step (a) comprises the step of providing a container for racket-sport balls, said container comprising said sidewall and said lip.

14. The method of claim 11 wherein the providing step (a) comprises the step of providing said container with said sidewall free of threads.

15. The method of claim 11 wherein the providing step (a) comprises the step of providing said container with the lip extending radially outwardly from the sidewall.

16. The method of claim 15 wherein the providing step (b) comprises the step of providing said cap with the sealing surface directed inwardly, and with the recess positioned near the end panel.

* * * * *

UNITED STATES PATENT AND TRADEMARK OFFICE

CERTIFICATE OF CORRECTION

PATENT NO. : 5,311,988
DATED : May 17, 1994
INVENTOR(S) : Henry D. Bronson

It is certified that error appears in the above-indentified patent and that said Letters Patent is hereby corrected as shown below:

In column 1, line 33, after "and" insert --Morris--.

In column 2, line 7 after "lip" delete ";".

In column 4, line 63, after "minutes" insert --.--.

Signed and Sealed this

Twenty-fifth Day of October, 1994

*Attest:*

*Attesting Officer*

Bruce Lehman

BRUCE LEHMAN

*Commissioner of Patents and Trademarks*